US008309837B2

(12) United States Patent
Hashimoto

(10) Patent No.: US 8,309,837 B2
(45) Date of Patent: Nov. 13, 2012

(54) TONE GENERATION CONTROL APPARATUS

(75) Inventor: Ryuji Hashimoto, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 13/187,072

(22) Filed: Jul. 20, 2011

(65) Prior Publication Data

US 2012/0017749 A1 Jan. 26, 2012

(30) Foreign Application Priority Data

Jul. 23, 2010 (JP) ..... 2010-165984

(51) Int. Cl.
*G10H 1/02* (2006.01)

(52) U.S. Cl. ..... 84/737

(58) Field of Classification Search ..... 84/723, 84/737, 741
See application file for complete search history.

(56) References Cited

U.S. PATENT DOCUMENTS

| | | | | |
|---|---|---|---|---|
| 2,001,723 | A | 5/1935 | Hammond, Jr. | |
| 3,571,480 | A | 3/1971 | Tichenor et al. | |
| 5,543,580 | A | 8/1996 | Masuda | |
| 5,902,949 | A | 5/1999 | Mohrbacher | |
| 5,922,985 | A * | 7/1999 | Taniwaki | 84/742 |
| 5,929,361 | A * | 7/1999 | Tanaka | 84/742 |
| 6,002,080 | A * | 12/1999 | Tanaka | 84/615 |
| 6,881,890 | B2 * | 4/2005 | Sakurada | 84/654 |
| 7,049,503 | B2 * | 5/2006 | Onozawa et al. | 84/723 |
| 7,741,555 | B2 * | 6/2010 | Onozawa | 84/653 |
| 7,985,916 | B2 * | 7/2011 | Shibata | 84/621 |
| 2004/0144239 | A1 * | 7/2004 | Sakurada | 84/616 |
| 2005/0056139 | A1 | 3/2005 | Sakurada | |
| 2005/0217464 | A1 * | 10/2005 | Onozawa et al. | 84/723 |
| 2007/0017352 | A1 | 1/2007 | Masuda | |
| 2007/0068372 | A1 | 3/2007 | Masuda | |
| 2007/0144336 | A1 | 6/2007 | Fujii | |
| 2008/0314226 | A1 | 12/2008 | Shibata | |
| 2009/0019999 | A1 * | 1/2009 | Onozawa | 84/658 |
| 2009/0288549 | A1 | 11/2009 | Masuda | |

FOREIGN PATENT DOCUMENTS

| | | | |
|---|---|---|---|
| CN | 1991972 | A | 7/2007 |
| CN | 101329862 | A | 12/2008 |
| EP | 1748416 | A1 | 1/2007 |
| EP | 2006834 | A1 | 12/2008 |
| FR | 2704968 | A1 | 11/1994 |
| FR | 2775823 | A1 | 9/1999 |

(Continued)

OTHER PUBLICATIONS

Extended European Search Report for corresponding EP 11174833.1, dated Nov. 2, 2011.

(Continued)

*Primary Examiner* — Jeffrey Donels
(74) *Attorney, Agent, or Firm* — Rossi, Kimms & McDowell LLP

(57) ABSTRACT

A tone generation apparatus detects a position of a mouthpiece section having been pressed by a human player holding the mouthpiece section in his or her mouth. The tone generation apparatus identifies a tone pitch on the basis of the detected position and human player's operation on a piston control. Also, the tone generation apparatus detects a pressure of breath blown by the human player into the mouthpiece section and generates a tone signal of a wind instrument having the identified tone pitch, and audibly reproduces the tone signal after amplifying the tone signal in accordance with a tone volume level corresponding to the detected pressure of breath.

12 Claims, 6 Drawing Sheets

FOREIGN PATENT DOCUMENTS

| | | | |
|---|---|---|---|
| GB | 2221078 | A | 1/1990 |
| JP | 07-199934 | | 8/1995 |
| JP | 2004-177828 | A | 6/2004 |
| JP | 2004-212578 | A | 7/2004 |
| JP | 2004-258443 | A | 9/2004 |
| JP | 2004-314187 | A | 11/2004 |
| WO | 2007/059614 | A1 | 5/2007 |

OTHER PUBLICATIONS

Chinese Office Action for corresponding CN201110207511.7, dated Apr. 12, 2012. English translation provided.

Notification of Reasons for Rejection dated Jan. 5, 2010 from JP 2005-250017. Cited in U.S. Appl. No. 11/468,488.

Extended European Search Report dated Apr. 2, 2007 from EP 06018130.2. Cited in U.S. Appl. No. 11/468,488.

Joel Gilbert et al.; "Artificial Buzzing Lips and Brass Instruments: Experimental Results", Journal of the Acoustical Society of America, vol. 104, No. 3, pp. 1627-1632, Acoustical Society of America, Sep. 1998. Cited in U.S. Appl. No. 11/468,488.

Atsuo Takanishi et al., "Development of an Anthropomorphic Flutist Robot WF-3RII", Intelligent Robots and Systems 1996, Proceedings of the 1996 LEEE/RSJ International Conference on Osaka, vol. 1, pp. 37-43, Japan, Nov. 4, 1996. Cited in U.S. Appl. No. 11/468,488.

* cited by examiner

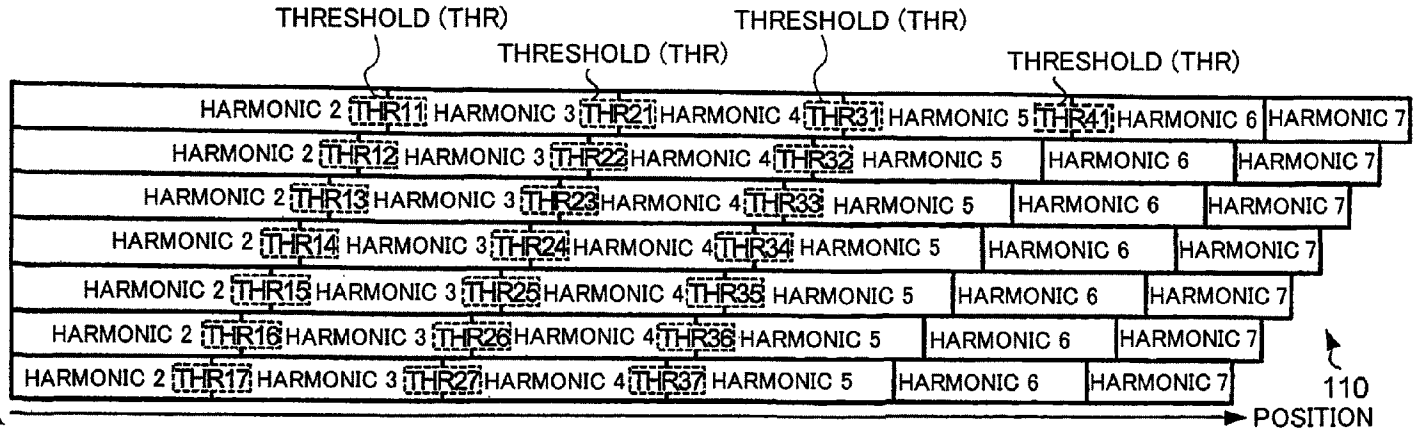
FIG. 4A
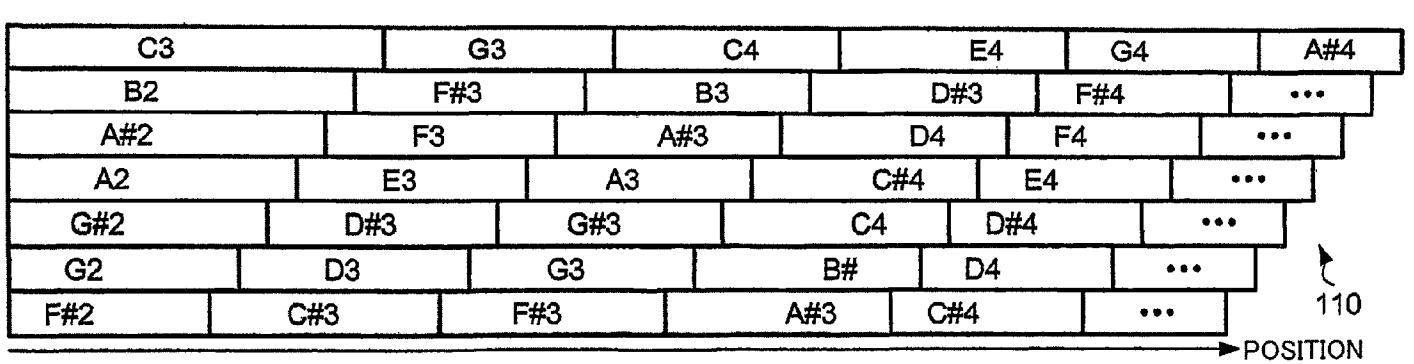
FIG. 4B
130
| BREATH PRESSURE | TONE VOLUME LEVEL |
|---|---|
| P1≦P<P2 | LEVEL 1 |
| P2≦P<P3 | LEVEL 2 |
| P3≦P<P4 | LEVEL 3 |
FIG. 4C

210

| | FINGERING (PISTON) | | | | | | |
|---|---|---|---|---|---|---|---|
| HARMONIC | 0 (OPEN) | 2 | 1 | 1•2 | 2•3 | 1•3 | 1•2•3 |
| ••• | ••• | ••• | ••• | ••• | ••• | ••• | ••• |
| 5 | E5 | E♭5 | D5 | D♭5 | C4 | B4 | B♭4 |
| 4 | C5 | B4 | B♭4 | A4 | A♭4 | G5 | G♭5 |
| 3 | G4 | G♭4 | F4 | E4 | E♭4 | D4 | D♭4 |
| 2 | C4 | B3 | B♭3 | A3 | A♭3 | G3 | G♭3 |

FIG. 7A

220

| POSITION | HARMONIC |
|---|---|
| X1≦X<X2 | 2 |
| X2≦X<X3 | 3 |
| X3≦X<X4 | 4 |
| X4≦X<X5 | 5 |
| ••• | ••• |

FIG. 7B

TONE GENERATION CONTROL APPARATUS

BACKGROUND

The present invention relates to tone generation control apparatus for generating tones of wind instruments.

Japanese Patent Application Laid-open Publication No. HEI-6-43867 (hereinafter referred to as "patent literature 1") discloses an electronic musical instrument which simulates performance operation and tone color (timbre) of a wind instrument. The electronic musical instrument disclosed in patent literature 1 is in the form of a wind instrument having a mouthpiece section, and, in response to a human player performing, with a finger, operation for designating a tone color and pitch within an octave pitch range, the electronic musical instrument generates a tone corresponding to the designated tone color and pitch. Further, Japanese Patent Application Laid-open Publication No. 2010-48909 ("patent literature 2") discloses an audio processing apparatus which outputs a tone of a wind instrument based on an octave corresponding to an angle at which a body device has been inclined by a human player and a note name corresponding to depressing operation by the human player.

However, with a real or natural wind instrument, a human player can freely change the tone pitch in response to motion of his or her lips applied to the mouthpiece and piston valve operation. Thus, a performance feeling felt by the human player when using a finger to designate a tone pitch on the conventionally-known electronic musical instrument or apparatus is completely different from an actual performance feeling (i.e., performance feeling felt by the human player when performing the real or natural wind instrument).

SUMMARY OF THE INVENTION

In view of the foregoing, it is an object of the present invention to provide an improved technique which allows a tone simulating a tone of a wind instrument to be generated with a performance feeling approximate to that of a real wind instrument.

In order to accomplish the above-mentioned object, the present invention provides an improved tone generation control apparatus, which comprises: a mouthpiece section adapted to be connected to a musical instrument body section and having a shape suitable for being operated by a mouth of a human player; a detector which detects a physical amount caused by operation, by the mouth of the human player, on the mouthpiece section; and a control section which identifies a tone pitch on the basis of the physical amount detected by the detector and generates tone pitch instruction data indicative of the identified tone pitch. With such arrangements, a tone pitch of a wind instrument can be identified in accordance with operation performed by the human operator on the mouthpiece section held in his or her mouth, and thus, the human player can execute a performance with a performance feeling approximate to that of a real wind instrument.

Preferably, the tone generation control apparatus of the present invention further comprises a control operable by a finger of the human operator, and an operation detection section which detects an operational state of the control. The control section identifies the tone pitch on the basis of a combination of the physical amount detected by the detector and the operational state of the control detected by the operation detection section, and the control section generates the tone pitch instruction data indicative of the identified tone pitch. With such arrangements, the human player can generate a tone through operation with his or her finger and operation on the mouthpiece section, so that the human player can execute a performance with a performance feeling approximate to that of a real or natural wind instrument.

Preferably, the tone generation control apparatus further comprises a sensor which detects a pressure of breath blown by the human player into the mouthpiece section, and a tone volume level of a tone to be generated in accordance with the tone pitch instruction data is identified in accordance with the pressure of breath detected by the sensor. With such arrangements, the human player can adjust the tone volume by blowing breath into the mouthpiece section.

Preferably, the tone generation control apparatus of the present invention further comprises a second detector which detects a second physical amount caused by second operation, by the mouth of the human player, on the mouthpiece section, and the control section generates, in accordance with the second physical amount detected by the second detector, data for controlling a characteristic of a tone to be generated in accordance with the tone pitch instruction data. Further, the second detector detects, as the second physical amount, a pressure force with which the mouthpiece section is held in a mouth of the human player, or the second detector detects, as the second physical amount, vibration applied to the mouthpiece section. With such arrangements, a performance style or rendition style can be varied in accordance with a force with which the human player holds the mouthpiece section in the mouth (or between the lips), or vibration applied by the human player to the mouthpiece section.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which:

FIGS. 4A and 4B are diagrams showing sections of a tone pitch/harmonic table, and FIG. 4C is a diagram showing a tone volume table;

FIG. 7A is a diagram showing a modified tone pitch table, and FIG. 7B is a diagram showing a modified harmonic table.

DETAILED DESCRIPTION

A tone generation control apparatus of the present invention is for use in an electronic musical instrument simulating a wind instrument, and an embodiment of the tone generation control apparatus of the present invention will hereinafter be described as used in a trumpet-type electronic musical instrument.

Figure 1:
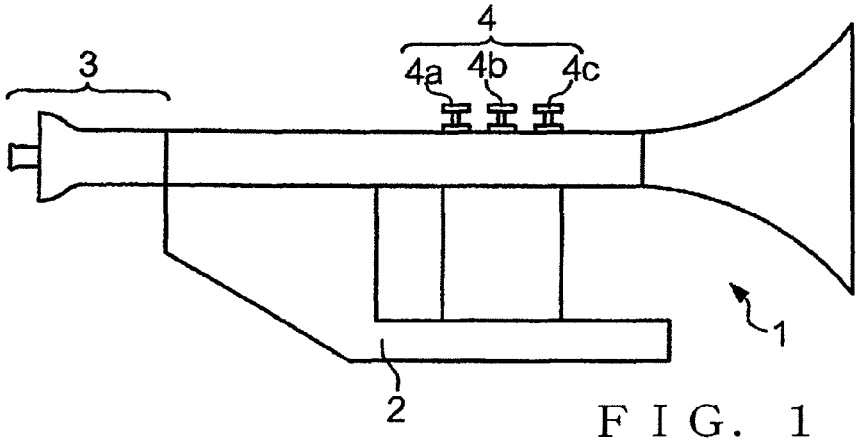
FIG. 1 is a view showing an outer appearance of an electronic musical instrument including an embodiment of a tone generation control apparatus of the present invention.

FIG. 1 is a view showing an outer appearance of the electronic musical instrument 1 employing the embodiment of the tone generation control apparatus. The electronic musical instrument 1 includes a body casing (instrument body section) 2 simulating a shape of a trumpet, a mouthpiece unit 3 through which a human player (or user) blows breath into the instrument 1, and a piston operation unit 4 provided on the body casing 2. The piston operation unit 4 includes three pistons, i.e. first piston 4*a*, second piston 4*b* and third piston 4*c*. Each of the pistons 4*a* to 4*c* is constructed to be depressed by a human player's finger into the body casing 2, and each of the pistons 4*a* to 4*c* is provided with a switch for detecting whether or not the piston has been depressed by the human player. A tone control device is constructed of the mouthpiece unit 3, piston operation unit 4 and related electronic circuitry. The following describe details of the mouthpiece unit 3.

<Mouthpiece Unit>

Figure 2A:
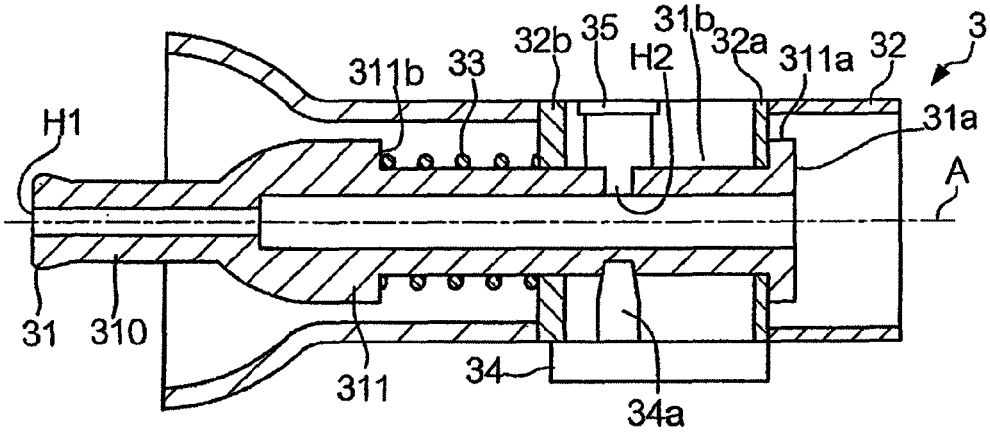
FIGS. 2A and 2B are sectional views showing the interior of a mouthpiece unit employed in the embodiment of the tone generation control apparatus.
Figure 2B:
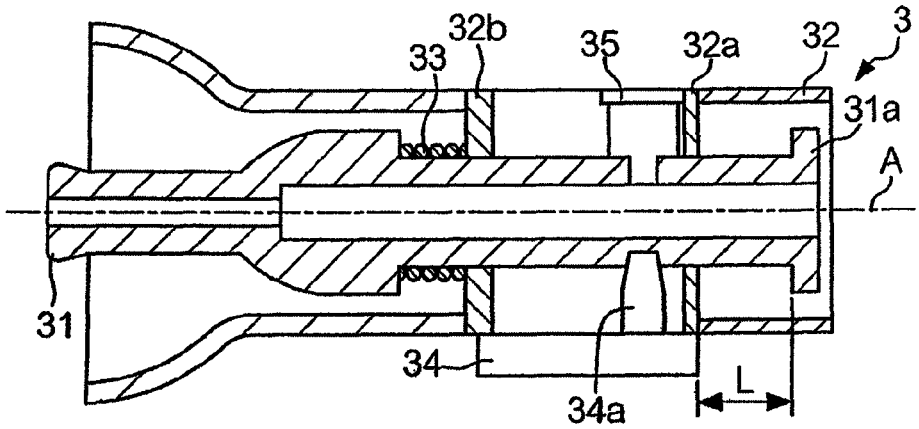

FIGS. 2A and 2B are sectional views showing the interior of the mouthpiece unit 3 employed in the instant embodiment. As shown in FIG. 2A, the mouthpiece unit 3 includes a mouthpiece section 31 in the form of a cylindrical member having a diameter increasing in a rightward direction of FIG. 2A, and a mouthpiece casing 32 in the form of a cylindrical member having a diameter increasing in a leftward direction of FIG. 2A. The mouthpiece section 31 and the mouthpiece casing 32 are disposed concentrically about a center axis A The mouthpiece section 31 includes a small-diameter portion 310 to be held in the human player's mouth (or between the lips of the human player), and a large-diameter portion 311 greater in diameter than the small-diameter portion 310. The small-diameter portion 310 and the large-diameter portion 311 extend coaxially with each other along the center axis A. The large-diameter portion 311 of the mouthpiece section 31 has an annular recessed portion 31*b* formed in the outer periphery thereof. An end surface 311*b* of the annular recessed portion 31*b* closer to the small-diameter portion 310 supports one end of a coil-shaped compression spring 33 wound around the outer periphery of the recessed portion 31*b*. An annular portion of the large-diameter portion 311 defining the other end surface 311*a* of the recessed portion 31*b* is provided as a stopper portion (flange) 31*a*. Further, the mouthpiece section 31 has a central hole H1 formed therein to extend axially through the mouthpiece section 31 from the small-diameter portion 310 to the stopper portion 31*a*. The large-diameter portion 311 has a hole H2 formed in the recessed portion 31*b* and radially extending through an upper region (i.e., upper region in FIG. 2A) of the recessed portion 31*b*, and a pressure sensor 35 is inserted in the hole H2. The large-diameter portion 311 also has a cavity (not shown with a reference numeral) in a lower region (i.e., lower region in FIG. 2A) of the recessed portion 31*b* opposite to the hole H2. The pressure sensor 35 moves along the axis A as the mouthpiece section 31 is moved along the axis A, to detect pressure variation in the hole H1 formed in the mouthpiece section 31 and thereby detect a pressure of breath blown via the small-diameter portion 310 of the mouthpiece section 31. Such a pressure of breath blown via the small-diameter portion 310 of the mouthpiece section 31 will hereinafter be referred to also as "breath pressure".

The mouthpiece casing 32 includes two ring-shaped or annular projecting members 32*a* and 32*b* that project inwardly from an inner wall portion of the mouthpiece casing 32 toward and short of the center axis A and that are spaced from each other by a predetermined distance in a direction of the center axis A. The annular projecting member 32*b* supports the other end of the compression spring 33; namely, the compression spring 33 is provided between, and fixed at its opposite end to, the end surface 311*b* of the annular recessed portion 31*b* and the annular projecting member 32*b*. The mouthpiece section 31 is axially movably supported at its outer peripheral surface by the inner peripheral surfaces of the annular projecting members 32*a* and 32*b*; namely, the mouthpiece section 31 is movable in parallel to the center axis A while being supported by the annular projecting members 32*a* and 32*b*. A sliding volume control 34 is provided on a lower portion (lower portion in FIG. 2A) of the mouthpiece casing 32, and a knob portion 34*a* movable along the center axis A as the mouthpiece section 31 is moved along the center axis A is inserted in the cavity (not shown with a reference numeral) opposite to the hole H2. A resistance value varying in response to the movement of the knob portion 34*a* corresponds to a current position of the mouthpiece section 31. Note that the sliding volume control 34 functions as a detector for detecting a physical amount caused by human player's operation performed on the mouthpiece section 31.

When no force is being applied to the mouthpiece section 31 in a direction toward the rear end of the mouthpiece casing 32 opposite from the front end of the mouthpiece casing 32 closer to the human player, the mouthpiece section 31 is held stationary by the compression spring 33 at a position (neutral position) where the stopper 31*a* and the projecting member 32*a* of the mouthpiece casing 32 abuttingly contact each other, as shown in FIG. 2A. As a force is applied to the mouthpiece section 31 in the direction toward the rear end of the casing 32, the compression spring 33 is compressed by the applied force, in response to which the mouthpiece section 31 moves toward the rear end of the casing 32 in parallel to the center axis A and the stopper 31*a* and the annular projecting member 32*a* of the mouthpiece casing 32 move away from each other. A limit of the movement of the mouthpiece section 31 toward the rear end of the mouthpiece casing 32 is at a position where the compression spring 33 is compressed to the greatest extent as shown in FIG. 2B and where the stopper 31*a* and the mouthpiece casing 32 are spaced from each other by a distance L.

Namely, the instant embodiment detects a physical amount caused by human player's mouth action or operation on the mouthpiece section 31 by detecting a position of the mouthpiece section 31 having moved in parallel to the center axis A. In an alternative, the instant embodiment may detect a load applied to the compression spring 33 when the mouthpiece section 31 has been pressed into the mouthpiece casing 32. Whereas the foregoing has described the construction of the mouthpiece unit 3, it should be appreciated that the interior construction of the mouthpiece unit 3 is not necessarily limited to the foregoing as long as the mouthpiece casing 32 and the mouthpiece section 31 are slidable relative to each other and arrangements are made for detecting a position of the mouthpiece section 31 and a pressure of breath blown into the mouthpiece section 31. The following describe a construction for the embodiment of the electronic musical instrument 1 to perform tone generation processing.

<Construction of Electronic Circuitry>

Figure 3:
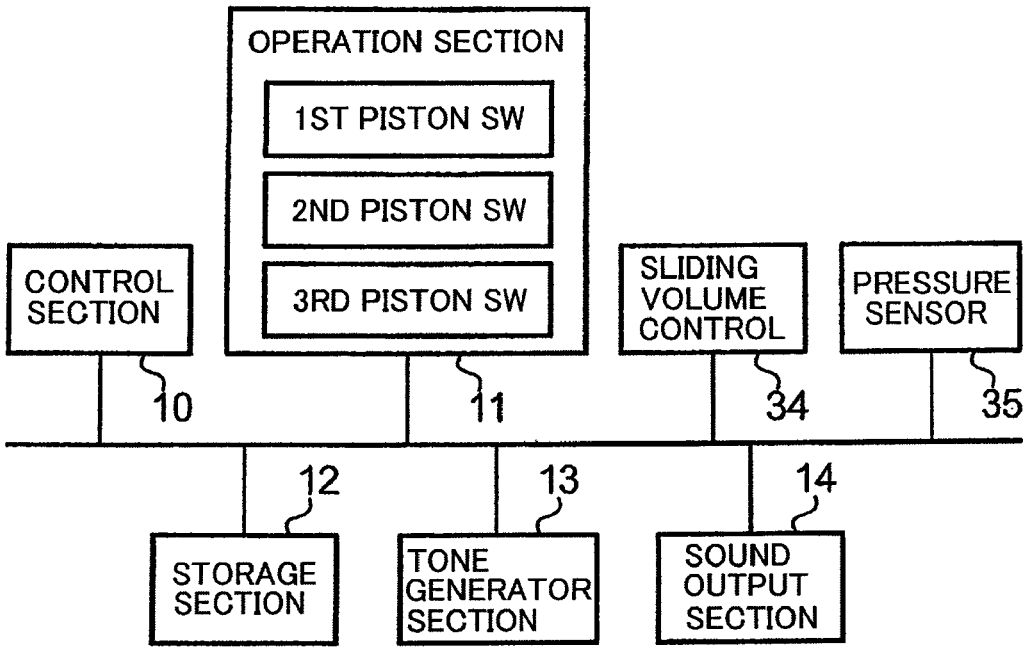
FIG. 3 is a block diagram showing an example construction of electronic circuitry to be used in tone generation processing performed by the electronic musical instrument.

FIG. 3 is a block diagram showing a construction of electronic circuitry for use in the tone generation processing by the electronic musical instrument 1. The electronic musical instrument 1 includes, on the body casing 2, a control section 10, an operation section 11, a storage section 12, a tone generator section 13, an sound output section 14, and the above-mentioned sliding volume control 34 and pressure sensor 35.

The control section 10 includes a CPU (Central Processing Unit), and a memory comprising a ROM (Read-Only Memory) and a RAM (Random Access Memory). By executing control programs stored in the ROM, the control section 10 controls various components connected to the control section 10. More specifically, the control section 10 not only identifies a tone pitch corresponding to a moved-to position of the mouthpiece section 31 and operated piston of the piston operation unit 4 but also identifies a tone volume corresponding to an intensity of breath blown by the human player into the mouthpiece section 31, and performs control for causing a tone of the identified tone pitch with the indentified tone volume level. Namely, the control section 10 identifies the tone pitch on the basis of a physical amount caused by human player's operation at least on the mouthpiece section 31 (i.e., output of the detector 34) and generates tone pitch instruction data that indicates the identified tone pitch.

The operation section 11 includes a switch for turning on or off a power supply (not shown) to the electronic musical instrument 1, and a first piston switch (SW), second piston switch and third piston switch corresponding to the first piston 4*a*, second piston 4*b* and third piston 4*c* of the piston control unit 4. In the instant embodiment, each of the piston switches outputs an ON/OFF signal indicative of whether or not the corresponding piston is currently in a depressed position. The sliding volume control 34 and the pressure sensor 35, provided in the aforementioned manner, output respective detection results to the control section 10.

The storage section 12, which is in the form of a non-volatile storage medium, stores therein various data, such as a tone pitch/harmonic table 110 and a tone volume table 130. Details of the tone pitch/harmonic table 110 and tone volume table 130 will be discussed later. The tone generator section 13, which is for example a tone generator based on the MIDI (Musical Instrument Digital Interface) standard, generates, on the basis of instruction information given from the control section 10, a tone signal of an instructed tone pitch of a trumpet and then sends the generated tone signal to the sound output section 14. The sound output section 14 includes an amplification section for amplifying the tone signal, input from the tone generator section 13, in accordance with an instruction from the control section 10, and a sounding section, such as a speaker, for audibly reproducing or sounding the amplified tone signal.

<Data>

The following describe the data stored in the storage section 12. FIGS. 4A and 4B show sections of the tone pitch/harmonic table 110. In the section of the tone pitch/harmonic table 110, as shown in FIG. 4A, fingerings and threshold values ("THR") of positions of the mouthpiece section 31 which correspond to individual harmonics are prestored in association with each other. Tone pitches corresponding to the individual harmonics shown in FIG. 4A are shown in FIG. 4B.

The fingerings shown in FIGS. 4A and 4B indicate depressing operation on the first piston 4*a*, second piston 4*b* and third piston 4*c*. More specifically, fingering "1" indicates depressing operation on the first piston 4*a*, fingering "2" indicates depressing operation on the second piston 4*b*, and fingering "3" indicates depressing operation on the third piston 4*c*. Further, fingering "0" indicates a state where all of the pistons are in the non-depressed, open position, fingering "1·2" indicates operation in which the first and second pistons 4*a* and 4*b* are depressed simultaneously, fingering "2·3" indicates operation in which the second and third pistons 4*b* and 4*c* are depressed simultaneously, fingering "1·3" indicates operation in which the first and third pistons 4*a* and 4*c* are depressed simultaneously, and fingering "1·2·3" indicates operation in which all of the pistons 4*a*, 4*b* and 4*c* are depressed simultaneously.

The harmonic indicates what integer multiple of a fundamental vibrational mode of air column resonance of the trumpet a vibration mode in question is. The threshold values (THR) indicate threshold values of positions of the mouthpiece section 31 predetermined in relation to individual harmonics; different threshold values are preset for different fingerings. In the illustrated example of FIG. 4A, the horizontal axis represents the position of the mouthpiece section 31 which increases in value in a direction of a rightward arrow. In FIG. 4A, a greater value of the position of the mouthpiece section 31 represents a position deeper into the mouthpiece casing 32; that is, the greater the value of the position of the mouthpiece section 31, the greater the amount of axial displacement, toward the rear end of the casing 32, of the mouthpiece section 31. In the instant embodiment, threshold values of positions of the mouthpiece section 31 corresponding to individual harmonics can be identified in response to a fingering on the basis of the section of the tone pitch/harmonic table data shown in FIG. 4A, and a particular tone pitch corresponding to the threshold value and the position of the mouthpiece section 31 detected on the basis of a resistance value of the sliding volume control 34 can be identified on the basis of the section of the tone pitch/harmonic table data shown in FIG. 4B.

For example, when the fingering is "2" and the position of the mouthpiece section 31 is in a range less than threshold value "THR12", "Harmonic 2" (second-order harmonic) is identified as shown in FIG. 4A, and, in this case, tone pitch "B2" is identified as shown in FIG. 4B. Further, when the fingering is "1" and the position of the mouthpiece section 31 is in a range less than threshold value "THR13", "Harmonic 2" is identified as shown in FIG. 4A, and, in this case, tone pitch "A#2" is identified as shown in FIG. 4B.

FIG. 4C shows an example format and example data of the tone volume table 130. In the tone volume table 130, breath pressures and tone volume levels are prestored in association with each other. "Breath Pressure" indicates a range of breath pressures corresponding to an output value of the pressure sensor 35, and "Tone Volume Level" indicates a tone volume level with which a tone signal is to be output in the corresponding range of breath pressures (in the illustrated example of FIG. 4C, P1<P2<P3<P4 . . . , and level 1<level 2<level 3 . . . ).

<Behavior>

Figure 5:
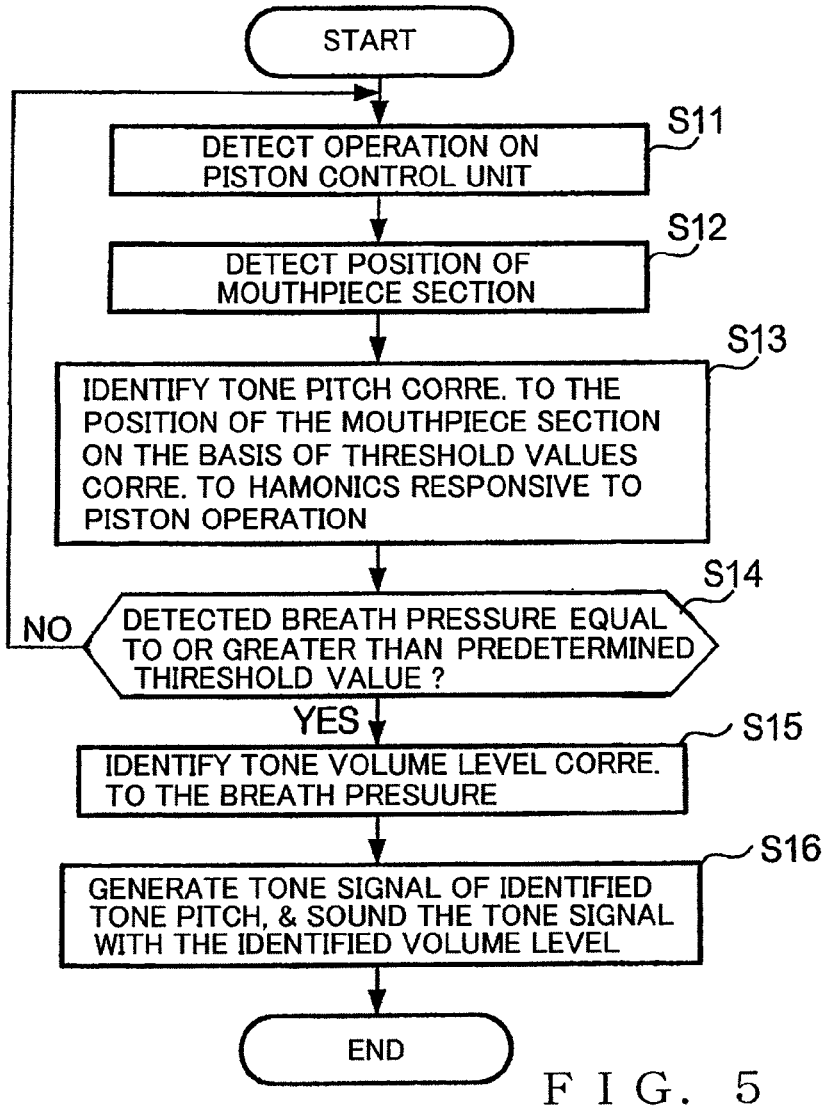
FIG. 5 is a flow chart of an example operational sequence of the electronic musical instrument.

The following describe behavior of the instant embodiment of the electronic musical instrument 1. FIG. 5 is a flow chart of an example operational sequence of the electronic musical instrument 1. The human player holds the mouthpiece section 31 of the electronic musical instrument 1 in his or her mouth (i.e., between the lips) to start a performance.

The control section 10 not only detects human player's operation on the piston operation unit 4 at step S11, but also detects a position of the mouthpiece section 31 by means of the sliding volume control 34 at step S12. The control section 10 then identifies a harmonic corresponding to the position of the mouthpiece section 31, detected at step S12, by referencing the section of the tone pitch/harmonic table 110 of FIG. 4A in the storage section 12 on the basis of the threshold values of positions of the mouthpiece section 31 corresponding to individual harmonics responsive to the operation on the piston operation unit 4 detected at step S11, and identifies, at step S13, a tone pitch corresponding to the identified harmonic and position of the mouthpiece section 31 on the basis of the section of the tone pitch/harmonic table 110 of FIG. 4B.

Further, the control section 10 detects breath, blown by the human player into the hole H1 of the mouthpiece section 31, by means of the pressure sensor 35, at step S14. When a breath pressure equal to or greater than a predetermined threshold value has been detected by means of the pressure sensor 35 (YES determination at step S14), the control section 10 references the tone volume table 130 of the storage section 12 to identify a tone volume level corresponding to the detected breath pressure and indicates the identified tone volume level to the sound output section 14, but also indicates the tone pitch, identified at step S13, to the tone generator 13, at step S15.

Then, the tone generator 13 generates a tone signal corresponding to the tone pitch indicated by the control section 10 and outputs the generated tone signal to the sound output section 14. The sound output section 14 amplifies the tone signal, output from the tone generator 13, in accordance with the tone volume level indicated by the control section 10 and then sounds the amplified tone signal with the identified tone volume, at step S16.

If no breath pressure equal to or greater than the predetermined threshold value has been detected by means of the pressure sensor 35 (NO determination at step S14), the control section 10 performs control to not generate a tone of the identified tone pitch, and it then repeats the operations at and after step S11.

<Specific Example of Behavior>

For example, as the human player depresses the first piston 4*a* and second piston 4*b* and presses the mouthpiece section 31 into the mouthpiece casing 32 rather weakly, the control section 10 receives ON signals output from the first piston 4*a* and second piston 4*b*, at step S11. Then, at step S12, the control section 10 detects, via the sliding volume control 34, that the mouthpiece section 31 has been pressed into the mouthpiece casing 32 within a range below threshold value "THR14", by referencing the threshold values of the mouthpiece section 31 corresponding to the individual harmonics responsive to fingering "1·2" in the section of the tone pitch/harmonic table 110 of FIG. 4A. At next step S13, the control section 10 identifies tone pitch "A2" corresponding to "Harmonic 2" for fingering "1·2", at step S13.

Once the human player blows breath into the mouthpiece section 31 and breath pressure "P3" equal to or greater than the predetermined threshold value is detected by means of the pressure sensor 35 (YES determination at step S14), the control section 10 receives the breath pressure "P3" from the pressure sensor 35, identifies tone volume level "Level 3", corresponding to the breath pressure "P3", and then indicates the identified tone volume level to the sound output section 14, at step S15. Then, the tone generator 13 generates a tone signal of the tone pitch "A2" indicated by the control section 10 and outputs the thus-generated tone signal to the sound output section 14. The sound output section 14 amplifies the tone signal, input from the tone generator 13, in accordance with the tone volume level indicated by the control section 10 and then sounds the amplified tone signal, at step S16.

For example, when tone pitch "A3" higher than the tone pitch "A2" is to be sounded with the same fingering as above, a tone signal of the tone pitch "A3" can be generating by the human player pressing the mouthpiece section 31 further into the mouthpiece casing 32 within a range equal to or greater than threshold value "THR24" of the mouthpiece section 31, corresponding to the tone pitch "A2", but below threshold value "THR34".

With the above-described embodiment, unlike the traditional technique where a tone pitch is designated by a hand, the human player can designate tone pitches through the operation of pressing (moving or displacing) the mouthpiece section 31 into the mouthpiece casing 32 and the operation of depressing any of the pistons, so that a tone of desired a tone pitch can be sounded just as in the case where a natural (acoustic) trumpet is performed.

In view of the fact that, in a performance of the natural (acoustic) trumpet, the tone pitch is adjusted through vibration of the lips and intensity of breath, the electronic musical instrument 1 may be constructed in such a manner that the reactive force of the compression spring 33 increases as the human player presses the mouthpiece section 31 deeper into the mouthpiece casing 32. In such a construction, the human player has to press the mouthpiece section 31 with a greater force as the tone pitch gets higher, so that the human player can execute a performance with a feeling more approximate to the natural trumpet.

<Modification>

The present invention should not be construed as limited to the above-described embodiment and may be modified variously as exemplified below. Further, various modifications explained below may be combined as desired.

Figure 6:
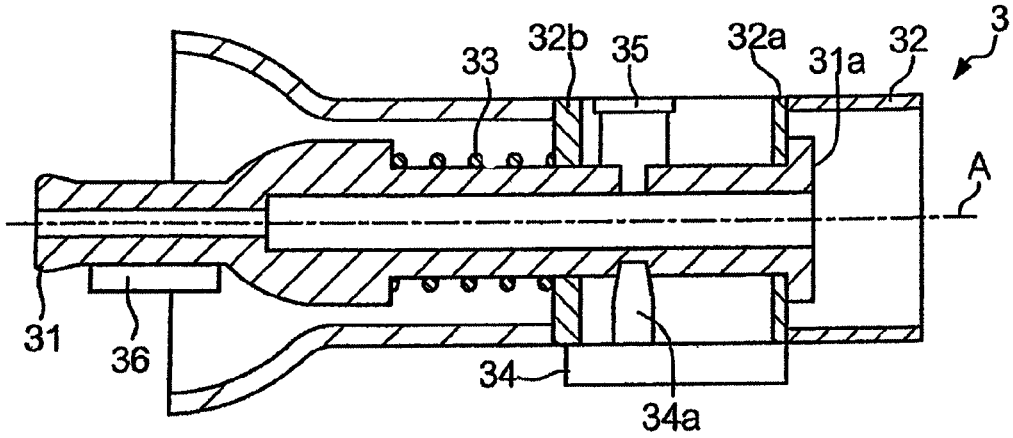
FIG. 6 is a sectional view showing a modified mouthpiece section.

(1) As a modification of the above-described embodiment, the mouthpiece section 31 may be provided with a pressure-sensitive sensor 36, as shown in FIG. 6. The pressure-sensitive sensor 36 is a sensor using pressure-sensitive conductive rubber, pressure-sensitive ink or the like, which detects, as a resistance value, a pressure force with which the human player holds the mouthpiece section 31 in the mouth (between the lips). Further, the storage section 12 of the electronic musical instrument 1 may prestore therein, as performance or rendition style information indicative of for example a vibrato, pitch ranges indicative of pitch bends corresponding to various possible detection values of the pressure-sensitive sensor 36; namely, pitch ranges corresponding to various possible forces with which the human player holds the mouthpiece section 31 in the mouth may be prestored as rendition style information in the storage section 12. In this way, the electronic musical instrument 1 can express a vibrato by continuously varying a tone pitch identified within a pitch range corresponding to a detection value of the pressure-sensitive sensor 36. Alternatively, lengths or the like corresponding to various possible forces with which the human player holds the mouthpiece section 31 in the mouth may be prestored as rendition style information in the storage section 12 so that articulation, such as a staccato or slur, can be varied in accordance with a mouthpiece-section holding force. Note that a vibration sensor may be provided in place of the pressure-sensitive sensor 36.

As an example arrangement for varying a rendition style as noted above, detection means, such as an acceleration sensor and vibration sensor, for detecting a swing of the mouthpiece section 31, mouthpiece unit 3 or the body of the electronic musical instrument 1 may be provided on the mouthpiece section 31, mouthpiece unit 3 or the body of the electronic musical instrument 1 so that human player's operation of swinging the electronic musical instrument 1 can be detected by the detection means. In this case too (i.e., as in the case where the pressure-sensitive sensor is employed), rendition style information determined in correspondence with various possible detection values of the detection means may be prestored in the storage section 12. Alternatively, detection results of the detection means may be substituted into a predetermined arithmetic expression to calculate rendition style information corresponding to the detection result.

(2) The embodiment has been described above as constructed to detect a physical amount (linear displacement) caused by operation performed, by the human player's mouth, on the mouthpiece section 31, by detecting a position within the mouthpiece casing 32 to which the mouthpiece section 31 has been pressed by the mouth. However, in a case where the mouthpiece section 31 is constructed to be rotatable relative to the mouthpiece casing 32, an amount of such rotation of the mouthpiece section 31 relative to the mouthpiece casing 32 may be detected via a rotational volume control; in this case, the physical amount is rotational displacement of the mouthpiece section 31. Also, a strain amount of the mouthpiece section 31 may be detected via a strain gauge or the like.

(3) Whereas the embodiment has been described above as using the tone pitch/harmonic table 110 in identifying a harmonic corresponding to a position of the mouthpiece section 31, such a harmonic may be calculated by substituting a detection result of the sliding volume control 34 into an arithmetic expression predetermined for calculating a harmonic.

(4) Whereas the embodiment has been described above as sounding tones of a trumpet, the present invention may be constructed to sound tones of other brass instruments, such as a trombone and cornett, and woodwind instruments. In such a case, a tone pitch/harmonic table 110 defining relationship between fingerings and harmonics corresponding to various musical instruments may be prestored in the storage section 12.

(5) The embodiment has been described above in relation case where threshold values of positions of the mouthpiece section 31 corresponding to various harmonics are determined in response to fingerings. As a modification, a tone pitch table 210 shown in FIG. 7A and a harmonic table 220 shown in FIG. 7B are prestored in the storage section 12. As shown in FIG. 7A, the tone pitch table 210 stores therein information indicative of tone pitches corresponding to harmonics (orders of harmonics) and fingerings (pistons). The harmonics and fingerings shown in FIG. 7A are similar to those explained in relation to the above-described embodiment.

According to the instant modification, in the vibration mode of the second-order harmonic (Harmonic 2), tones of pitch ranges from "G♭3" to "C4" are associated with individual fingerings, as shown in the row of "Harmonic 2". In the vibration mode of the third-order harmonic (Harmonic 3), tones of pitch ranges from "D♭3" to "G4" are associated with individual fingerings, as shown in the row of Harmonic 3. In the case of the fourth-order and fifth-order harmonics too, tones of various tone pitches are associated with harmonics and fingerings.

Further, as shown in FIG. 7B, the harmonic table 220 has positions of the mouthpiece section 31 and harmonics prestored therein in association with each other. More particularly, values of harmonics corresponding to positions of the mouthpiece section 31 detected by resistance values of the sliding volume control 34 are prestored in the harmonic table 220. Namely, in this modification, a threshold value of the position of the mouthpiece section 31 is prestored per harmonic. Thus, a harmonic corresponding to the detected position of the mouthpiece section 31 can be identified by reference to the harmonic table 220, and once a fingering is identified, one tone pitch can be identified by reference to the tone pitch table 210.

Figure 8:
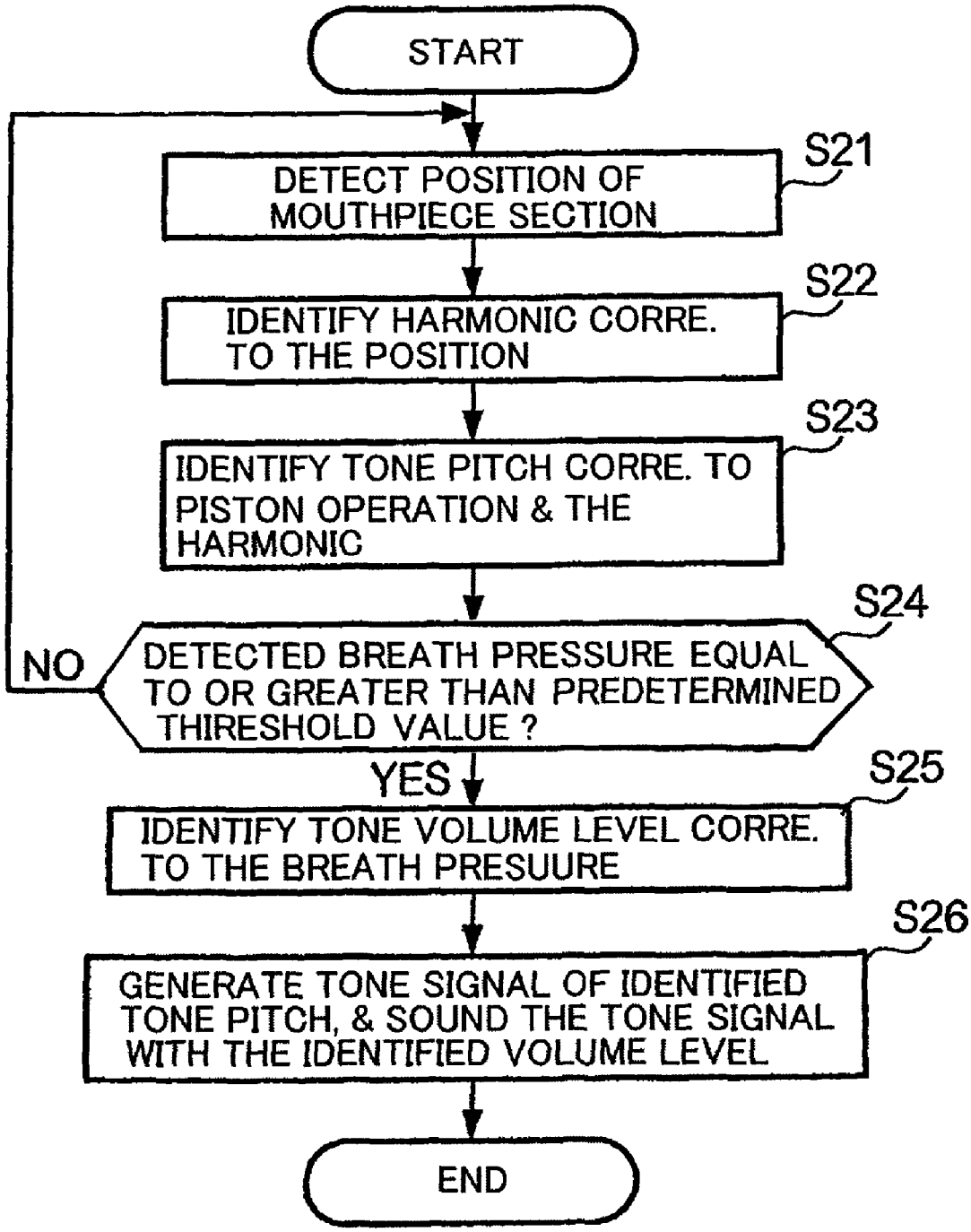
FIG. 8 is a flow chart of modified tone generation control processing.

The following describe tone generation control processing using the aforementioned tone pitch table 210 and harmonic table 220, a flow chart of which is shown in FIG. 8. Once the mouthpiece section 31 has been pressed by the human operator into the mouthpiece casing 32, the control section 10 detects a position of the mouthpiece section 31 by means of the sliding volume control 34, at step S21. Then, the control section 10 identifies a harmonic corresponding to the detected position of the mouthpiece section 31 by referencing the harmonic table 220 stored in the storage section 12, at step S22. Further, the control section 10 receives an ON signal from the piston switch of any one of the pistons depressed by the human player, and identifies a tone pitch corresponding to the piston switch having output the ON signal and the identified harmonic by referencing the tone pitch table 210, at step S23.

Once the human player blows breath into the hole H1 of the mouthpiece section 31 and a breath pressure equal to or greater than a predetermined threshold value is detected by the pressure sensor 35 (YES determination at step S24), the control section 10 not only references the tone volume table 130 of the storage section 12 to identify a tone volume level corresponding to the detected breath pressure and indicates the identified tone volume level to the sound output section 14 but also indicates the tone pitch, identified at step S23, to the tone generator 13, at step S25.

Then, the tone generator 13 generates a tone signal corresponding to the tone pitch indicated by the control section 10 and outputs the generated tone signal to the sound output section 14. The sound output section 14 amplifies the tone signal, output from the tone generator 13, in accordance with the tone volume level indicated by the control section 10 and then sounds the amplified tone signal, at step S26.

If no breath pressure equal to or greater than the predetermined threshold value has been detected by means of the pressure sensor 35 (NO determination at step S24), the control section 10 performs control to not generate a tone of the identified tone pitch, and it repeats the operations at and after step S21.

<Specific Example of Behavior>

For example, as the human player depresses the first piston 4*a* and second piston 4*b* while pressing the mouthpiece section 31 into the mouthpiece casing 32 rather weakly, the sliding volume control 34 detects position "X2" of the mouthpiece section 31 at step S21. Then, the control section 10 receives the position "X2" of the mouthpiece section 31 from the sliding volume control 34 and identifies harmonic "3" including the position "X2" of the mouthpiece section 31 from the harmonic table 220 of the storage section 12, at step S22. Also, the control section 10 receives ON signals from the first piston 4*a* and second piston 4*b*, identifies, from the tone pitch table 210, tone pitch "E4" (note name "E") corresponding to the fingering "1·2" and harmonic "3", and indicates the identified tone pitch "E4" to the tone generator section 13, at step S23. Once the human player blows breath into the mouthpiece section 31 so that pressure of breath "P3" equal to or greater than a predetermined threshold value is detected by means of the pressure sensor 35 (YES determination at step S24), the control section 10 receives the pressure of breath "P3" from the pressure sensor 35, identifies, from the tone volume table 130, tone volume level "level 3" corresponding to the pressure of breath "P3", and indicates the identified tone volume to the sound output section 14, at step S25. Then, the tone generator section 13 generates a tone signal of the tone pitch "E4" indicated by the control section 10 and sends the generated tone signal to the sound output section 14, so that the sound output section 14 amplifies the tone signal, input from the tone generator section 13, in accordance with the tone volume level "level 3" indicated by the control section 10 and audibly reproduces or sound the thus-amplified tone signal at step S26.

This application is based on, and claims priority to, JP PA 2010-165984 filed on 23 Jul. 2010. The disclosure of the priority application, in its entirety, including the drawings, claims, and the specification thereof, are incorporated herein by reference.

What is claimed is:

1. A tone generation control apparatus for a musical instrument, the tone generation control apparatus comprising:

a mouthpiece section adapted to be connected to a musical instrument body section of the musical instrument and having a shape suitable for being operated by a mouth of a human player;

a detector adapted to detect a physical amount caused by operation, by the mouth of the human player, at the mouthpiece section; and a control section adapted to identify a tone pitch on the basis of the physical amount detected by the detector and generate tone pitch instruction data indicative of the identified tone pitch;

a control operation unit adapted to be operable by a finger of the human operator; and an operation detection section adapted to detect an operational state of the control operation unit, wherein the control section is further adapted to:

identify the tone pitch on the basis of a combination of the physical amount detected by the detector and the operational state of the control operation unit detected by the operation detection section;

generate the tone pitch instruction data indicative of the identified tone pitch;

identify a harmonic corresponding to the physical amount detected by the detector and the operational state of the control detected by the operation detection section by referencing a tone pitch/harmonic table; and identify the tone pitch based on the identified harmonic and the operational state of the control operation unit detected by the operation detection section.

2. The tone generation control apparatus as claimed in claim 1, further comprising:

a sensor adapted to detect a pressure of breath blown by the human player into the mouthpiece section, wherein a tone volume level of a tone to be generated in accordance with the tone pitch instruction data is identified in accordance with the pressure of breath detected by the sensor.

3. The tone generation control apparatus as claimed in claim 1, wherein:

the mouthpiece section is linearly displaceable, and the physical amount detected by the detector is a position corresponding to linear displacement of the mouthpiece section.

4. The tone generation control apparatus as claimed in claim 1, wherein:

the mouthpiece section is rotatable with respective the musical instrument body section, and the physical amount detected by the detector is a position corresponding to rotational displacement of the mouthpiece section.

5. The tone generation control apparatus as claimed in claim 1, wherein:

the mouthpiece section is provided for movement relative to the musical instrument body section, and the detector detects a position of the mouthpiece section relative to the musical instrument body section.

6. The tone generation control apparatus as claimed in claim 5, which further comprising a spring for returning the mouthpiece section, relative to the musical instrument body section, back to a neutral position.

7. The tone generation control apparatus as claimed in claim 1, further comprising:

a second detector adapted to detect a second physical amount caused by second operation, by the mouth of the human player, on the mouthpiece section, wherein the control section generates, in accordance with the second physical amount detected by the second detector, data for controlling a characteristic of a tone to be generated in accordance with the tone pitch instruction data.

8. The tone generation control apparatus as claimed in claim 7, wherein the second detector detects, as the second physical amount, a force with which the mouthpiece section is held in the mouth of the human player.

9. The tone generation control apparatus as claimed in claim 7, wherein the second detector detects, as the second physical amount, vibration applied to the mouthpiece section.

10. An electronic musical instrument comprising:

a musical instrument body section;

a mouthpiece section connected to the musical instrument body section and having a shape suitable for being operated by a mouth of a human player;

a detector adapted to detect a physical amount caused by operation, by the mouth of the human player, at the mouthpiece section;

a control section adapted to identify a tone pitch on the basis of the physical amount detected by the detector and generate tone pitch instruction data indicative of the identified tone pitch;

a control operation unit adapted to be operable by a finger of the human operator; and an operation detection section adapted to detect an operational state of the control operation unit, wherein the control section is further adapted to:

identify the tone pitch on the basis of a combination of the physical amount detected by the detector and the operational state of the control operation unit detected by the operation detection section;

generate the tone pitch instruction data indicative of the identified tone pitch;

identify a harmonic corresponding to the physical amount detected by the detector and the operational state of the control detected by the operation detection section by referencing a tone pitch/harmonic table; and identify the tone pitch based on the identified harmonic and the operational state of the control operation unit detected by the operation detection section.

11. The tone generation control apparatus as claimed in claim 1, wherein:

the tone pitch/harmonic table is configured to prestore, for each of a plurality of possible operational states of the control, a plurality of threshold values of the physical amount corresponding to a plurality of harmonics, and the control section identifies the harmonic by referencing the tone pitch/harmonic table on the basis of the physical amount detected by the detector and the operational state of the control detected by the operation detection section.

12. A tone generation control apparatus for a musical instrument, the tone generation control apparatus comprising:

a mouthpiece section adapted to be connected to a musical instrument body section of the musical instrument and having a shape suitable for being operated by a mouth of a human player;

a first detector adapted to detect a first physical amount caused by first operation, by the mouth of the human player, at the mouthpiece section; and a second detector adapted to detect a second physical amount caused by second operation, by the mouth of the human player, at the mouthpiece section;

a control section adapted to identify a tone pitch on the basis of the physical amount detected by the first detector and generate tone pitch instruction data indicative of the identified tone pitch, wherein the control section generates, in accordance with the second physical amount detected by the second detector, data for controlling a characteristic of a tone to be generated in accordance with the tone pitch instruction data, and wherein the second detector detects, as the second physical amount, vibration applied to said mouthpiece section.

* * * * *